US010463084B2

(12) United States Patent
Carneiro

(10) Patent No.: US 10,463,084 B2
(45) Date of Patent: Nov. 5, 2019

(54) GARMENT AND MANUFACTURING METHOD

(71) Applicant: COFEMEL—Sociedade de Vestuário, S.A., Lousado (PT)

(72) Inventor: Beatriz Vila Nova Azevedo Costa Carneiro, Fradelos (PT)

(73) Assignee: COFEMEL—Sociedade de Vestuário, S.A., Lousado (PT)

( * ) Notice: Subject to any disclaimer, the term of this patent is extended or adjusted under 35 U.S.C. 154(b) by 357 days.

(21) Appl. No.: 14/885,380

(22) Filed: Oct. 16, 2015

(65) Prior Publication Data

US 2016/0106160 A1 Apr. 21, 2016

(30) Foreign Application Priority Data

Oct. 17, 2014 (EP) ..... 14398010

(51) Int. Cl.
*A41D 1/06* (2006.01)
*D06L 1/12* (2006.01)
(Continued)

(52) U.S. Cl.
CPC ..... *A41D 1/06* (2013.01); *D05B 1/06* (2013.01); *D06F 35/005* (2013.01); *D06L 1/12* (2013.01); *D06L 4/13* (2017.01); *D06M 15/227* (2013.01); *D06M 15/564* (2013.01); *A41D 27/24* (2013.01); *A41D 31/00* (2013.01); *A41D 2300/22* (2013.01); *A41D 2500/54* (2013.01)

(58) Field of Classification Search
CPC ..... A41D 1/06; A41D 27/24; A41D 31/00; D06L 4/13
USPC ..... 2/227; 428/35.7, 36.1, 36.4
See application file for complete search history.

(56) References Cited

U.S. PATENT DOCUMENTS 5,540,982 A 7/1996 Scholz et al.
5,761,747 A * 6/1998 Eagleson ..... A41B 9/02 2/227
(Continued)

FOREIGN PATENT DOCUMENTS

CN 103469577 A 12/2013
EP 0326285 A2 8/1989
(Continued)

OTHER PUBLICATIONS

European Search Report of EP14398010 dated Apr. 17, 2015.
(Continued)

*Primary Examiner* — Timothy K Trieu
(74) *Attorney, Agent, or Firm* — Sughrue Mion, PLLC

(57) ABSTRACT

Garment and manufacturing method, describes a one size garment (1) for different sizes of women or men, made of a fabric comprising at least a natural non-elastic fiber material, a first synthetic fiber material and a second elastic synthetic fiber material, these synthetic fibers being covered by polyurethane and polyethylene, having chain stitch seams (3) using 100% polyester thread (4) in which are also stretchy, which join together the different pieces (2) to form the garment; and in that said garment (1) has a distressed look in certain areas of the material. The manufacture thereof comprises making, by hand or machine, using round point needles and a subsequent wash process in two phases, in which an emulsion to protect the elastic fibers is added.

10 Claims, 3 Drawing Sheets

(51) Int. Cl.

| | |
|---|---|
| ***D06M 15/227*** | (2006.01) |
| ***D06M 15/564*** | (2006.01) |
| ***D05B 1/06*** | (2006.01) |
| ***D06F 35/00*** | (2006.01) |
| ***D06L 4/13*** | (2017.01) |
| *A41D 27/24* | (2006.01) |
| *A41D 31/00* | (2019.01) |

(56) References Cited

U.S. PATENT DOCUMENTS

| | | | | |
|---|---|---|---|---|
| 6,401,250 | B1 * | 6/2002 | McNabb | A41D 1/06 2/227 |
| 2011/0010817 | A1 * | 1/2011 | Theberge | A43B 1/0045 2/69 |
| 2013/0205467 | A1 * | 8/2013 | Walrich | A41D 27/10 2/93 |
| 2014/0165265 | A1 * | 6/2014 | Tulin | A41D 1/06 2/234 |
| 2014/0215685 | A1 * | 8/2014 | Bush | A41D 19/01523 2/161.1 |

FOREIGN PATENT DOCUMENTS

| | | | |
|---|---|---|---|
| JP | 2007-23465 | A | 2/2007 |
| JP | 2014-95156 | A | 5/2014 |
| WO | 95/11647 | A1 | 5/1995 |
| WO | 99/65433 | A1 | 12/1999 |
| WO | 2008/023386 | A2 | 2/2008 |

OTHER PUBLICATIONS

"Sailrite Sewing Machine Needle Selection", Sailrite Enterprises Inc., XP055183890, Jan. 1, 2011.

International Search Report of PCT/KR99/00324 dated Dec. 3, 1999.

* cited by examiner

GARMENT AND MANUFACTURING METHOD

OBJECT OF THE INVENTION

The present invention, garment and manufacturing method, refers to a garment with special stretchable properties and to its manufacturing method to achieve the stretchable properties in the garment. The garment is preferably a pair of denim trousers, fitted jeans, and more specifically stretchable trousers that look expressly distressed or aged. Anyway, other garments can be manufactured with stretchable properties.

The structure of said garment, due to the high stretch capacity provided by the combination of raw materials used to make the fabric, the type of thread, the chain stitch seam employed to join the different pieces forming the garment, and the treatment applied to the fabric forming the garment, makes the same a stretchy garment. When the garment is a pair of denim trousers, the same are typically denim, stretchy trousers. In addition, it refers to one single size garment, preferably trousers, to fit to any human body, regardless of its size.

The manufacturing method, firstly considers hand or machine making of the garment with the aforementioned type of stitching and fabric, and secondly considers a special treatment during the washing process, to protect the synthetic fibres of the fabric, in order to prevent them from being damaged and to therefore extend the durability of the stretchable properties of said fibres.

The present invention falls within the application field of the apparel manufacturing industry and focuses particularly on the area of denim trousers and more specifically, stretchy trousers with an aged look.

BACKGROUND OF THE INVENTION

As well known, jeans are a type of trousers made from a material known as denim, which is essentially made of cotton twill with white weft threads and indigo-dyed warp threads, which give it its characteristic colour. In the past, the material was used to make work clothes; it has been used widely to make all kinds of "denim" clothing, of which there are multiple varieties in terms of design and the mixture of materials with other materials, in addition to cotton.

Amongst said varieties, jeans that include certain percentages of polyester and elastane, in order to give them a particular stretchiness are known. However, in the majority of cases, said stretchiness is very limited and in general, does not enable the material to return to its original size once it has been stretched, even less so after the item of clothing has been washed. The elastic properties of the elastane are lost after several uses and washings. The only aim thereof is to provide the trousers with the stretchiness required for a certain fit to the body's curves. However, it cannot, of course, be used across all different women's, men's or kids sizes, thus meaning that it is usually necessary to make different sizes for each type of trousers, on the contrary that the present invention.

The aim of the present invention therefore is to develop a new type of garment, and specially fitted trousers, the stretchiness of which enables one sized garment to be used by all different sizes by women, men or kids, therefore making the manufacturing thereof far more economical, since it is no longer necessary to make different sizes of the same garment.

Likewise, when the garment has to show a jean or denim look, more or less aged, the application of treatments to age the jean material and give the fabric a distressed look in certain areas of the same is known about. However, these treatments use abrasive methods that may damage both the material and the seams, thus meaning that there is a risk of the item of clothing breaking. The manufacturing method of garments according to the present invention includes a specific washing treatment, which prevents any kind of distress on the stretchy material and protects the synthetic fibres in the fabric of the garment to maintain the elasticity in the same along the time, preventing its damage caused by its successive use and washing.

With reference to the current state of the art, it must be noted that although there are different types of garments in the denim field, the main garment with elasticity and denim look are the trousers. There are multiple types of denim trousers in the market, some of which include stretchy material, the existence of garments or denim trousers with similar technical and structural features to the garment hereby described, is unknown to the applicant.

Specifically, none of the fitted trousers manufactured in the state of the art refers to one size trousers that adjusts to women, men or kids of different sizes. Further no garment is known that satisfies the previous condition. Specifically, according to the present invention, one size garment fits all the sizes, especially in terms of its stretch properties. It should be understood that a garment manufactured for women fits all women sizes, a garment manufactured for men fits all men sizes and a garment manufactured for kids fits all kids sizes. Anyway, it could also be possible to manufacture a garment that could fit on men and women.

Anyway, no garment manufactured in the state of the art adjusts to all sizes as the garment proposed herein. This is due firstly because said prior art garment is manufactured in different sizes, thus meaning one garment is not suitable for all sizes, the elasticity thereof being limited, by the exclusive properties of the fibre itself. Secondly, it may be attributed to the different composition of the material, as well as using a low percentage of elastane that does not enable the shape of the garment to be regained once the material has been stretched, even less so after it has been washed, as well as the thread used for the seams and the type of stitch employed to join the different pieces that form the garment. Thirdly, in the case that the garment is a pair of trousers, it is because the product is manufactured in black and indigo blue colours and is not a pair of trousers subjected to a wash treatment to give them an aged denim look, thus meaning we cannot conclude that it constitutes a pair of strictly distressed denim trousers like the ones proposed in the present invention.

Moreover, in document US2014/0165265A1, by Levi Strauss & Co., a "Shaped fit sizing system with body shaping" is described, wherein a pair of fitted denim trousers is disclosed, which are nevertheless characterised in that they are developed according to a specific shape, in order to accommodate the different shapes of the female body, highlighting natural curves and minimising defects, by including additional pieces. As a result, such trousers are very different from the pair of stretchy trousers proposed herein.

Document EP2740373A1, by De Faria Sousa, describes "stretch trousers" which are characterised in that they are designed to sculpt the figure, preferably the female figure, from the ankles to the waist, via a series of changes in how the pieces that form the trousers are made, in comparison to typical trousers, in order to successfully elongate the figure with a slimming effect and increase women's comfort. These trousers are made of a material containing 60%-70% cotton, 20%-40% polyester and 3%-5% elastane. However, in addition to not being conceived to be able to adapt to all women's size, there is no mention to any type of thread or type of seam that increases the contribution to the stretchiness of the trousers, nor are they submitted to any treatment to protect the elastic fibres and give the trousers a distressed look, as with the pair of trousers of the present invention. The elastane actually used in clothes loses its properties after using and washing the clothes several times, reducing the durability of the clothes in comparison with the same clothes without elastane.

Furthermore, another pair of trousers is known through document US2013/0174324A1, by David Israel, specifically, an "Elastic stretching gathered denim fabric jean", which enables a personalised fit to the body, giving a unique look through its combination of fabric made of a mix of semi-elastic denim fabric and gathered fabric, gathered by hand or machine and the stitching thereof, gathered vertically with elastic thread, from top to the bottom. In this case, therefore, the stretchiness of the pair of trousers is only produced in the vertical direction, by the gathered seams which, as shown in the exemplary figures, give a wrinkled look to the material, which is substantially different to the stretch effect in any direction achieved by the pair of trousers of the present invention, in order to fit to any women's size, this being achieved with a very different type of seam that does not wrinkle or gather.

In conclusion, none of the aforementioned documents, taken separately or in combination, describe garment or trousers like those disclosed in the present invention as claimed, nor does it seem that any of them aim at or achieve the aforementioned objective of being able to use the same sized garment or trousers, for women, men or kids, of any size, as a result of their noteworthy stretch and shape recovering capacity.

BRIEF DESCRIPTION OF THE INVENTION

The garments, object of the present invention are essentially differentiated with respect to the prior state of the art garments, in that once they are made up with a fabric comprising a natural non-elastic fibre material, a first synthetic non-elastic fibre material and a second synthetic elastic fibre material, they are subjected to a treatment that protects the non-elastic fibre, from the first synthetic material, and elastic fibre, from the second synthetic material, that are twisted together within the fabric. Also, all the seams joining the different pieces together to form the garments, are made using chain stitch (interconnecting in groups to form interlinked loops), using 100% polyester thread.

In the prior art garments where the chain stitch is used, non all the seams of the garment use this type of stitch because the same requires more thread and more dressmaking time.

It should be understood as garment any clothing or outfit to be used by a man, a woman, a girl or a boy, such as shirts, trousers, t-shirts, shorts, jackets, skirts, etc.

The first object of the invention is therefore a garment, made up of different pieces, the fabric of said garment comprising at least a natural non-elastic fibre material, a first synthetic non-elastic fibre material, and a second elastic synthetic fibre material. Further, said synthetic fibres, non-elastic and elastic, are twisted together with the fabric, and are covered by protective components, preferably by polyurethane and polyethylene. The polyurethane contributes to eliminate the static charges, avoiding the separation of the synthetic, non-elastic and elastic, fibres, while the polyethylene helps soften and reduces to a minimum the wrinkles of the fibres. It should be understood as covered by the protective components, when referred to the synthetic fibres, that the same are completely coated, encapsulated, enclosed or encircled by said protective components. Further, all the extension of the synthetic fibres twisted together is covered by the protective components.

The different pieces forming the garment are joined by a chain stitch seam using polyester thread. Said chain stitch consists in the interconnection of the thread in groups forming interlinked loops.

Specifically, due to the stitch and the combined action of the polyethylene and the polyurethane, the fabric of the garment allows the width of the garment (because the elastane is disposed horizontally in the fabric) to be doubled, stretching said fabric a 100%, at the same time that the fabric does not lose its stretchable properties after several uses and washings of the garment. According to the present invention, one size garment can fit different women, men or kids sizes.

Further, the fabric preferably comprises in the range of 64% and 66% in weight of natural non-elastic fibre material, in the range of 28% and 33% in weight of a first non-elastic synthetic fibre material, and in the range of 3% and 4% in weight of a second elastic synthetic fibre material. The quantity of polyethylene in the garment is in the range of 0.1%, and 0.3% in weight and the quantity of polyurethane in the garment is in the range of 0.1%, and 0.3% in weight.

The natural non-elastic fibre material can be chosen among any natural fibre material that can be used within the textile industry, such as alpaca, angora, byssus, camel hair, cashmere, catgut, chiengora, guanaco, llama, mohair, pashmina, qiviut, rabbit, silk, sinew, spider silk, wool, abacá, bagasse, bamboo, coir, cotton, flax (linen), hemp, jute, kapok, kenaf, pine, raffia, ramie or sisal.

The first synthetic non-elastic fibre material can be chosen among any non-elastic synthetic fibre that can be used in the textile industry such as nylon, modacrylic, olefin, acrylic, polyester or carbon fibre.

The second synthetic elastic fibre is spandex or elastane, also known as lycra.

The polyurethane is preferably Evo fin ash or a similar product and the polyethylene is Denimcol Soft Pen or similar.

In more detail, it is important to note that the composition of the stretchy material used to make the garment is preferably made of cotton, polyester and elastane respectively. More specifically, the preferred composition comprises in the range of 65.4% and 65.6% of cotton, in the range of 30% and 32% of texturized polyester and in the range of 3.4% and 3.6 of elastane, preferably Lycra® which has unequalled stretch and recovery properties, in comparison to any other kind of elastane. Said elastane fibre, twisted together with the texturized polyester fibre, are covered by protective components to increase its durability. As a result, this material is notably stretchy and resistant, in addition to having a high ability to recover its shape. The garment properties, mainly its capacity to stretch, are not affected by successive washes or uses and it recovers its original size immediately after undressing. No further actions have to be made on the garment. This is due to the use of elastane, and more specifically Lycra®, and more specifically because said elastane, twisted with the texturized polyester fibre, is protected by specific components during the washing process.

Furthermore, the polyester thread used, is specifically a 100% polyester thread, in order to give the seams of the garment resistance combined with the aforementioned type of chain-stitch seam, which is carried out leaving the loops thereof on the inner part of the garment. This provides the garment with a much greater stretch capacity than that of any other garments referred to as being stretchy. Moreover, polyester is a highly-resistant synthetic fibre, which also—combined with the chain-stitch and the interlinked loops—enables the seams to stretch and allow them to recover without breaking.

A second object of the invention is the manufacturing process for producing the garment object of the present invention, wherein a step for making the pieces and a subsequent wash treatment are addressed. The washing treatment takes place not only for one garment but for a number of garments, depending on the industrial washing facilities, although the method could be exclusively applied to one garment too. Further, the process can combine industrial operations applied to a number of garments at the same time, as well as handmade operations applied to one garment at the time.

Mainly, when the fabric is received, the same is unrolled and relaxed preferably for 24 hours and afterwards the fabric goes through different steps to make up the garment. After cutting the different pieces of the fabric to form the garment, manually or with machines, said different pieces are sewn between them using round point needles, to prevent the damage to the raw material and to the elastic fibre of the fabric. After dressmaking the garment, and before fixing the accessories to the garment, such as buttons, rivets and exterior labels (the zipper, when required, is applied to the garment at this point), the garment is subjected to a washing treatment, preferably an industrial washing treatment. The washing process comprises a step where specific components are added to the garment to protect the synthetic fibres, preferably texturized polyester and elastane, twisted together, and to assure that elasticity in said fibres is not damaged, prolonging the original mechanical properties of said fibres.

Further, said washing process also constitutes a key step in the manufacturing process of the garment since abrasives are not used to give the garment an aged look. This is usual in the case of conventional denim wash processes. In all the washing phases that require it, the mechanical action is carefully controlled, guaranteeing the softness required to not damage the material. Furthermore, drying is carried out at low temperatures until a 5%-10% humidity point is reached, which serves to ensure too the quality of the product. Moreover, an emulsion of polyurethane and polyethylene are added close to the end of the washing process to provide to the texturized polyester and elastane fibres, twisted together within the fabric, with a covering or coating that, as already mentioned, protects said synthetic fibres, texturized polyester and elastane, and prevents the same from moving, giving the garment and excellent long-lasting elasticity.

Said emulsion comprises in the range of 1% and 5%, of the total weight of the garments being washed in a washing machine, of polyurethane, and in the range of 2 g/l and 7 g/l, of the total liters of water used in the bath in the washing machine, of polyethylene. Preferable ranges are in the range of 2% and 3% of polyurethane and in the range of 3 g/l and 5 g/l of polyethylene.

The washing process can also contribute, further to apply the protective components on the texturized polyester and elastane fibres, to give the garment, a distressed or aged look when required, especially when the garment is made up of a denim fabric.

The washing process can comprise two washing phases, preferably, each of them comprising different stages. Depending on the type of garment and the finishing to be obtained of the same, some of the washing steps, except the application of polyurethane and polyethylene could be optional.

The first washing phase comprises a first step where all the oils, waxes and grease that may eventually have been incorporated naturally or accidently, during the prior stitching and weaving process are removed or cleaned from the fabric that constitutes the material from which the garment is made. The second step is rinsing to improve the cleanliness of the fabric. A last step of enzymatic washing is needed adding enzymes to the process to provide a surface shine to the fabric. Further, another step is rinsing again to improve the cleanliness of the fabric, after which the garment is taken out of the washing machine. Next, the garment is dried at a low temperature. To finish this first phase of the washing process, a solution of K2MnO4 (potassium permanganate), is applied.

Before applying this last solution to the garment, a first quality control is carried out, inspecting the garments to separate those that may have been damaged as a result of the mechanical action.

Further, after applying the potassium permanganate solution, a second quality control can be carried out to verify that the physical and visual aspect of the garments complies with the sample. The garments that overcome the control are subsequently sent back to the industrial washing machine sector, where the second wash process is carried out.

The second washing phase comprises, as a first step, a bath for neutralising the K2MnO4 previously applied. A gentle mechanical action is applied during this bath. Further, the garments are submitted to a rinsing step to be followed by a final softening step, where the garments are submerged in a bath with the polyurethane and polyethylene emulsion to protect the texturized polyester and elastane fibres, twisted together, within the fabric. To finish, the garments are dried, preferably in drying machines, at a low temperature until the humidity of the garment is in the range of 5% and 10%. The low temperature is to avoid the damage of the elastic fibre, and regarding the humidity in the range of 5%-10%, the mechanical drying process stops when the garment retains approximately said 5% and 10% of humidity to prevent the excessive mechanical drying of the garment. The pending humidity will dry up naturally, according to air temperature. Anyway, the humidity will never reach 0% due to the fact that the highest percentage of the composition of the fabric is cotton, which, being a natural fibre, always naturally retains some humidity. A final quality control can be applied to verify that at all the physical and structural aspects of the garments are met. This control is carried out once the production is 100% complete.

The polyurethane and polyethylene, should be added immediately before the mechanical drying because prior to this step other components, usually chemical ones, are added and removed, and these components could affect to the features provided by the polyurethane and polyethylene if these were added before. Further, the fact of applying the polyurethane and polyethylene just before the drying contributes to improve the fixation of both components to the synthetic fibres of the fabric, as well as reinforce the protection of the fibres in the seams, due to the heat provided by said drying step.

Depending of the garment to be manufactured, slightly different steps could be taken in the manufacturing process. For example, when the fabric used to make the garment has to be dyed because the raw material does not have the desired final colour of the garment, the dying of the garment can be done prior to the cutting of the fabric or once the washing step has started, and therefore once the garment has already been made up. Anyway, the protective covering of the texturized polyester and elastane fibres, twisted together, is added at the end of the washing process of the garment, no matter if the same was made with already dyed fabric or if said garment was made in raw fabric (undyed) to be garment dyed after.

According to the present invention, the fabric of the garment has a 100% percentage of elasticity regarding width, therefore meaning that the garment can double up its width corresponding to the maximum size that can be reached by the garment.

DESCRIPTION OF THE DRAWINGS

With the aim of facilitating a better understanding of the features of the invention, a set of drawings is attached to the present specification as an integral part thereof, in which, by way of non-limiting examples, the following figures are included.

PREFERRED EMBODIMENT OF THE INVENTION

In light of the aforementioned figures and in accordance with the reference numbers included therein, a preferred, but non-limiting embodiment of a garment object of the present invention is hereby described. The embodiment described herein will refer to a pair of trousers although it can be applied to other garments or clothing.

Figure 5:
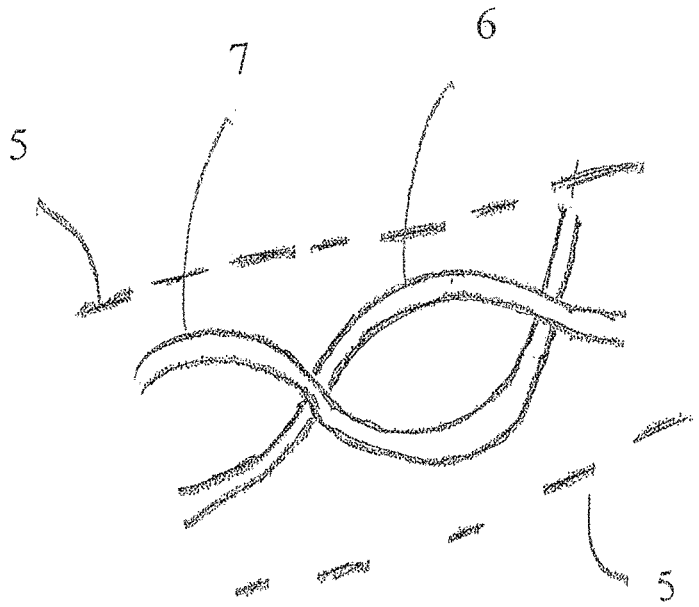
FIG. 5 illustrates the synthetic fibres, non-elastic and elastic, being twisted together and covered by a protective component.

The fabric of the garment comprises at least a natural non-elastic fibre material, a first synthetic non-elastic fibre material, and a second elastic synthetic fibre material. Further, as illustrated in FIG. 5, the synthetic fibres, non-elastic 6 and elastic 7, are twisted together and are covered by protective components 5, preferably by polyurethane and polyethylene. The polyurethane contributes to eliminate the static charges, avoiding the separation of the synthetic, non-elastic and elastic, fibres, while the polyethylene helps soften and reduces to a minimum the wrinkles of the fibres. It should be understood as covered by the protective components, when referred to the synthetic fibres, that the same are completely coated, encapsulated, enclosed or encircled by said protective components. Further, all the extension of the synthetic non-elastic fibres 6 and synthetic elastic fibres 7 twisted together is covered by the protective components 5.

Figure 1:
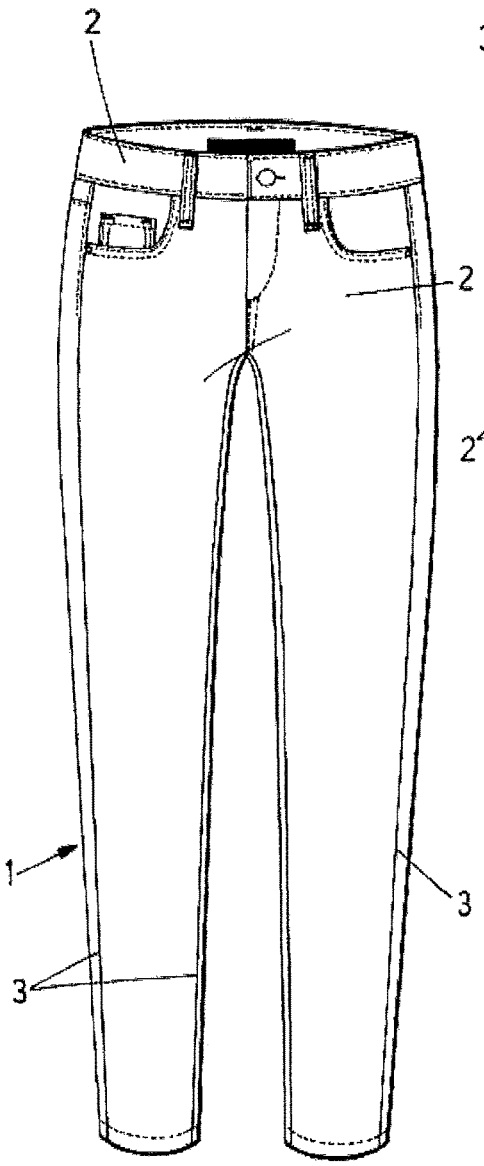
FIGS. 1 and 2 show respective schematic representations, in front and back elevation, respectively, of an exemplary embodiment of a garment according to the present invention, specifically a distressed look pair of stretchy denim trousers wherein the general configuration thereof may be observed.
Figure 2:
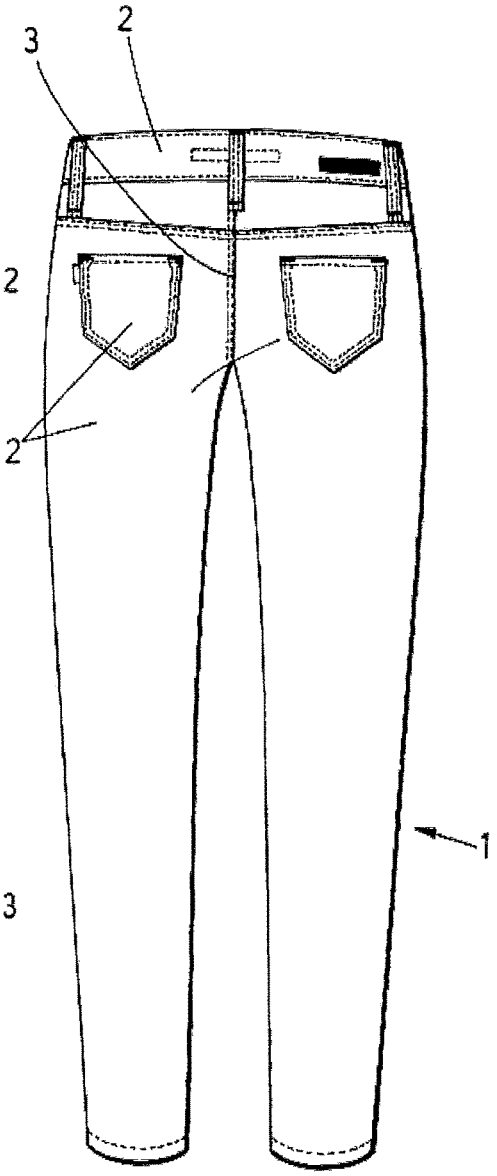
Figure 3:
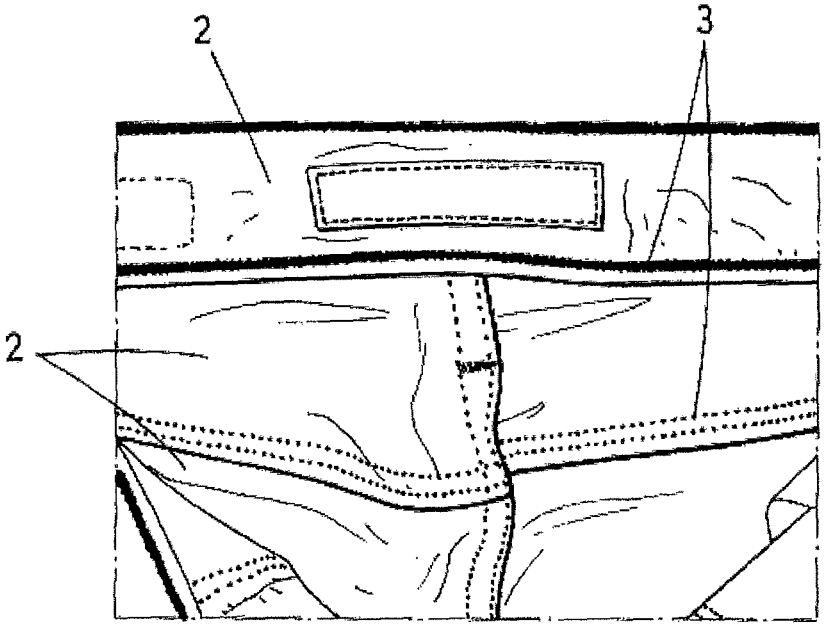
FIG. 3 shows a detailed view of a portion of the inner part of the trousers, according to the invention, wherein the chain stitch used to make them and the position on the inner part of the loops of said stitch may be observed.
Figure 4:
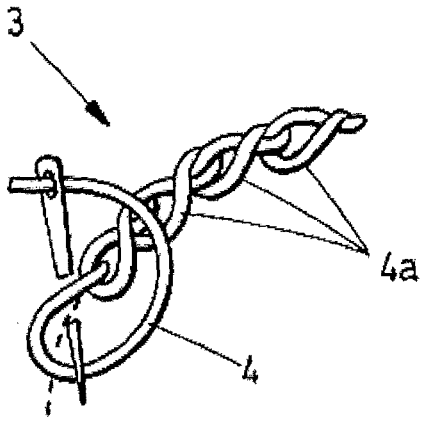
FIG. 4 shows a representation of the chain stitch with which the parts of the pair of trousers object of the invention are sewn.

Therefore, as can be seen in the figures, the pair of trousers (1) is made of pieces (2) of denim fabric, consisting of a very stretchy material, which comprises in the range of 65.4% and 65.6% in weight of cotton as a natural non-elastic fibre material, in the range of 30% and 32% in weight of texturized polyester, as a first synthetic non-elastic fibre material 6, and in the range of 3.4% and 3.6% in weight of elastane, preferably Lycra®, as a second synthetic elastic fibre material 7, being the first synthetic non elastic fibre and the second synthetic elastic fibre twisted together within the fabric as illustrated in FIG. 5. The different pieces of the fabric are joined together with all the seams (3) that are also very stretchy, made of 100% polyester thread (4) with chain stitch, as FIG. 4) shows, which consists of thread (4) interconnecting in groups that form interlinked loops (4*a*). Said seams are placed on the inner part of the trousers (FIG. 3).

Round point needles are used to make the chain stitch seams (3), which are preferably made by machine. Preferably, 5 stitches per cm are applied to assure that the seams stretch.

Once manufactured, the pair of trousers is subjected to a washing treatment, comprising a step to protect the texturized polyester and elastane fibres within the fabric and further, as the trousers are made of a denim fabric, the washing process is used too to give the trousers a distressed look in certain areas of the material. Said washing process is divided in two washing phases, and using washing machines.

The first washing phase comprises a first step where all the oils, waxes and grease that may eventually have been incorporated during the prior stitching and weaving process are removed from the fabric that constitutes the material from which the trousers are made. This step time is about 10 minutes at a temperature of 45° C., wherein the trousers are submerged in a bath at a ratio of 1:10 (ratio between the weight of the trousers and the quantity of water) to which enzymes (amylase) are applied with a specific combination of two dispersing agents, preferably Indisan iv and Rialdet tr, to remove and prevent the re-deposition of any of the hydrolysed colouring. Other dispersing agents with similar properties could also be used. A smooth mechanical action to move it is applied.

After, the trousers are subjected to a rinsing step.

Right after, another step consisting of an enzymatic wash for 5 minutes, in a bath at 45° C., to which latest generation enzymes (cellulase) are added at a ratio of 1:6 (ratio between the weight of the trousers and the quantity of water) is applied. This step provides a surface shine to the fabric. Alongside the enzyme, a specific combination of two dispersing agents is once again added, in order to remove and prevent the hydrolysed colouring from being deposited again, and therefore providing extra cleanliness to the fabric and to the accessories that make up the trousers. It is also subjected to a gentle mechanical action.

Further, another step is rinsing again to improve the cleanliness of the fabric, after which the trousers are taken out of the washing machine and carefully centrifuged to extract part of the water incorporated in the previous process.

Next, the trousers are dried at a low temperature until they reach a humidity point in the range of 5% and 10%.

To finish this first phase of the washing process, a solution of $K_2MnO_4$ (potassium permanganate) is applied preferably by a manual spraying process, on certain parts of the trousers, such as knees, waist, pockets or back causing the typical distress of "vintage look" jeans. This operation is carried out carefully, using mannequins with pressure sensors that cut the pressurised air inlet for the optimal implementation of the operation, and thus preventing the seams and/or the material from getting damaged.

After this first washing phase and some quality controls, the trousers are subjected to a second washing phase.

The second washing phase comprises, as a first step, neutralising the K2MnO4 previously applied. During this process, the trousers are submerged in a bath at 45° C. for 10 minutes, wherein sodium metabisulfite is added, at a ratio of 1:10, alongside yet another specific combination of two dispersing agents, preferably the same as before, which remove and prevent any hydrolysed colouring from re-depositing. This provides extra cleanliness for the raw material and accessories that make up the trousers. A gentle mechanical action is applied during this bath.

After another rinsing step, the trousers are subjected to a final softening, where the pair of trousers are once again submerged in a bath at 40° C. for 5 minutes, and wherein a quantity of emulsion of polyurethane and a quantity of polyethylene is added, at a ratio of 1:10 (ratio between total weight of the trousers and quantity of water in the washing machine), giving the trousers a good surface feel and at the same time, preventing the fibres that comprise the material structure from moving, thus removing static charges. The quantity of polyurethane applied is in the range of 1% and 5%, of the total weight of the trousers in the washing machine, of polyurethane, and in the range of 2 g/l and 7 g/l, of the total liters of water in the washing machine, of polyethylene. Preferably, the quantity of polyurethane is in the range of 2% and 3% and the quantity of polyethylene is in the range of 3 g/l and 5 g/l. The polyurethane should preferably be "Evo Fin Ash", or similar products, and the polyethylene preferably is Denimcol Soft Pen, or similar products.

After the washing process and specially after the treatment for applying the polyurethane and polyethylene to protect the texturized polyester and elastane fibres, twisted together, within the fabric, the composition of the trousers or garment is slightly different to the one of the starting fabric due to the introduction of the polyurethane and polyethylene in said fabric to the cover the synthetic fibres. The new composition of the garment will further comprise in the range of 0.1% and 0.3% in weight of polyurethane and in the range of 0.1% and 0.3% in weight of polyethylene.

The final result is trousers or garments where its width can double up, allowing one size trousers or garment for women, men or kids to fit all sizes of women, men or kids respectively.

As an example, the size range of an ordinary pair of women's trousers is 25, 26, 27, 28, 29, 30, 31, 32, 33 while a pair of trousers according to the present invention, covers all the seven sizes. This means that one size trousers according to the present application can be worn by women of all different sizes.

The invention claimed is:

1. A garment (1), made up of different pieces (2) of fabric, said fabric comprising:

between 64% and 66% in weight of a natural non-elastic fibre material, between 28% and 33% in weight of a first synthetic fibre material, and between 3% and 4% in weight of a second elastic synthetic fibre material, wherein at least the fibres of the synthetic fibre materials are twisted together, wherein the twisted synthetic fibres are covered with polyurethane and polyethylene, and wherein the pieces (2) of fabric forming the garment are joined by a chain stitch seam using polyester thread (4).

2. The garment according to claim 1, wherein the chain stitch seam consists in the interconnection of the thread (4) in groups forming interlinked loops (4*a*).

3. The garment according to claim 1, wherein the natural non-elastic fibre material is cotton.

4. The garment according to claim 1, wherein the first synthetic fibre material is texturized polyester.

5. The garment according to claim 1, wherein said second elastic synthetic fibre material is elastane.

6. The garment according to claim 1, wherein the thread (4) is 100% polyester.

7. The garment according to claim 1, wherein the garment is a pair of stretchy denim fabric trousers.

8. The garment according to claim 1, wherein the natural non-elastic fibre material comprises between 65.4% and 65.6% in weight of cotton, wherein the first synthetic fibre material comprises between 30% and 32% in weight of texturized polyester, and wherein the second elastic synthetic material comprises between 3.4% and 3.6% in weight of elastane.

9. A garment (1), made up of different pieces (2) of fabric, said fabric comprising:

between 64% and 66% in weight of a natural non-elastic fibre material, between 28% and 33% in weight of a first synthetic fibre material, and between 3% and 4% in weight of a second elastic synthetic fibre material, wherein at least the fibres of the synthetic fibre materials are twisted together, wherein the twisted synthetic fibres are covered with polyurethane and polyethylene, wherein the pieces (2) of fabric forming the garment are joined by a chain stitch seam using polyester thread (4), and wherein the content of polyurethane covering the synthetic fibres is in the range of 0.1% and 0.3% in weight.

10. A garment (1), made up of different pieces (2) of fabric, said fabric comprising:

between 64% and 66% in weight of a natural non-elastic fibre material, between 28% and 33% in weight of a first synthetic fibre material, and between 3% and 4% in weight of a second elastic synthetic fibre material, wherein at least the fibres of the synthetic fibre materials are twisted together, wherein the twisted synthetic fibres are covered with polyurethane and polyethylene, wherein the pieces (2) of fabric forming the garment are joined by a chain stitch seam using polyester thread (4), and wherein the content of polyethylene covering the synthetic fibres is in the range of 0.1% and 0.3% in weight.

* * * * *